United States Patent [19]

Irie

[11] 4,057,603

[45] Nov. 8, 1977

[54] SAFETY APPARATUS FOR A CARBURETOR

[75] Inventor: Gen Irie, Asaka, Japan

[73] Assignee: Honda Giken Kogyo Kabushiki Kaisha, Tokyo, Japan

[21] Appl. No.: 668,789

[22] Filed: Mar. 19, 1976

[30] Foreign Application Priority Data

Mar. 24, 1975 Japan ..... 50-38406[U]

[51] Int. Cl.[2] ..... F02M 5/02

[52] U.S. Cl. ..... 261/70; 123/198 DB; 137/39; 137/45

[58] Field of Search ..... 123/198 DB; 137/39, 137/45, 43; 261/DIG. 50, DIG. 2, 70

[56] References Cited

U.S. PATENT DOCUMENTS

| | | | |
|---|---|---|---|
| 1,843,186 | 2/1932 | Wolfard | 261/70 |
| 1,916,060 | 6/1933 | Memini | 261/70 |
| 1,927,426 | 9/1933 | Wahlmark | 261/70 |
| 2,433,405 | 12/1947 | Stamm | 137/45 |
| 2,570,557 | 10/1951 | Johnson | 137/45 |
| 2,861,583 | 11/1958 | Collirer | 137/39 |
| 3,236,496 | 2/1966 | Rosenstein et al. | 261/70 |
| 3,382,881 | 5/1968 | Charron | 137/39 |
| 3,916,928 | 11/1975 | Enoch | 137/39 |
| 3,964,503 | 6/1976 | Kikuchi | 261/DIG. 67 |

*Primary Examiner*—Tim R. Miles

[57] ABSTRACT

Safety apparatus for a carburetor comprising a float chamber having a float therein following the liquid level of the fuel and provided above the float is a fuel valve arranged to be pushed to closed position by the float on upward movement thereof. A pendulum type weight is pivotably mounted below the float within the chamber to close the fuel valve and prevent fuel outflow if the vehicle is overturned.

1 Claim, 3 Drawing Figures

SAFETY APPARATUS FOR A CARBURETOR

FIELD OF THE INVENTION

This invention relates to a safety apparatus for a carburetor in an internal combustion engine mainly for use in a motorcar or the like.

BACKGROUND OF THE INVENTION

It has been conventional with this kind of carburetor that a float chamber is provided therein with a float following the liquid level and there is provided above the float a fuel valve arranged to be pushed to closed position by the float upon upward movement thereof. This type of carburetor, however, has the danger that when the carburetor, and accordingly the float chamber which is integral therewith, becomes inclined, for example, on overturning of the vehicle, the float is not always moved upwards and the fuel valve can remain open and the interior fuel can flow out therethrough and result in a fire.

SUMMARY OF THE INVENTION

An object of the invention is to provide an apparatus which is free from the foregoing danger. Namely, according to the invention, in an arrangement of the type wherein a float chamber has a float therein following the fuel level, a pendulum is pivotably mounted below the float for rocking in the event of inclination of said chamber to close said fuel valve and prevent leakage of fuel.

DETAILED DESCRIPTION

Figure 1:
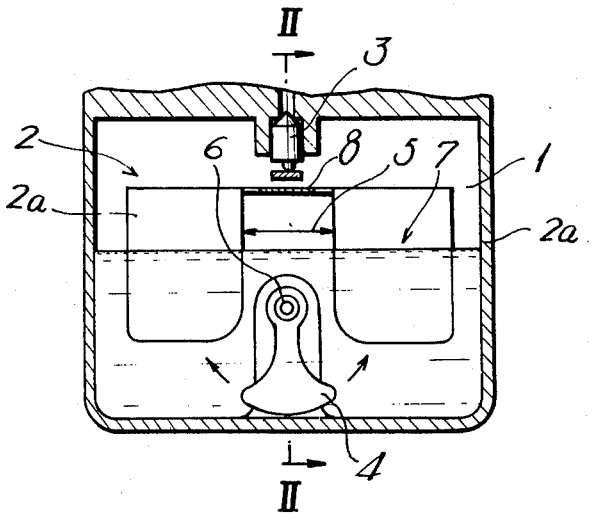
FIG. 1 is a sectional front view of one embodiment according to this invention.

Referring to the drawing, therein is seen a float chamber 1 provided with a float 2 following the liquid level in the chamber and provided above the float is a fuel valve 3 arranged to be pushed to closed position by the float 2 on upward movement thereof. A pendulum-type weight 4 is provided below the float 2 within the chamber 1.

In the illustrated embodiment, the float 2 is composed of two half portions 2*a*, disposed on the left and right with a space 5 therebetween and the weight 4 is disposed at its upper portion within the space 5 and is pivotally supported by a shaft 6. Numeral 7 denotes the liquid level of the fuel within the chamber 1, numeral 8 denotes a supporting arm for the float 2 and numeral 9 denotes a supporting shaft supporting the base end portion of arm 8.

The operation of the apparatus will now be explained as follows.

Figure 2:
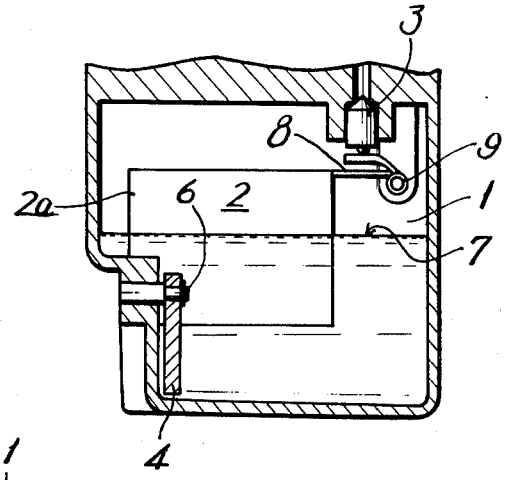
FIG. 2 is a sectional view taken along line II — II in FIG. 1.
Figure 3:
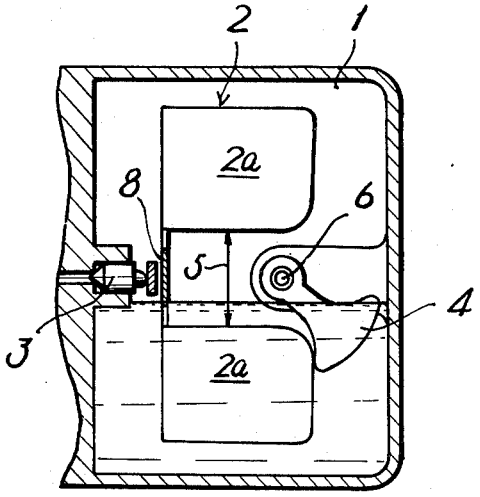
FIG. 3 is a sectional front view showing a condition of operation of the embodiment.

In the ordinary condition, as shown in FIGS. 1 and 2, the float 2 follows the liquid level 7 to move upwards and downwards, and at a predetermined height of the liquid level 7 the fuel valve 3 is automatically pushed to closed position. If it is now supposed that the chamber 1, for example, is inclined due to overturning of the vehicle, the float 2 is disposed sideways as shown, for instance, in FIG. 3, and in this case the weight 4 pivots about the shaft 6 at the top portion thereof to apply a pushing force on the float 2 from the bottom surface thereof, so that the fuel valve 3 is pushed to its closed position and there is no danger of leakage of fuel.

Thus, according to this invention, upon inclination of the float chamber 1 due to overturning of the vehicle or the like, the weight 4 is moved to push the float 2 from the bottom surface thereof to provide an automatic closing of the fuel valve 3, thereby preventing the fuel valve 3 from remaining open to cause leakage of fuel and possible outbreak of a fire. The weight 4 is positioned below the float 2 in normal condition so that it does not hamper the normal operation of the float 2.

What is claimed is:

1. Safety apparatus for a carburetor comprising a float chamber adapted for containing fuel therein, said float chamber having opposite end walls, a float, a first shaft mounted proximate one of said end walls pivotably supporting said float in said chamber to follow the level of the fuel therein, a fuel valve disposed above said float for being closed thereby upon upward movement of the float, a pendulum weight, a second shaft mounted at the other end wall and pivotably supporting said pendulum weight in said chamber beneath said float for applying force to said float to close said fuel valve upon inclination of said chamber, said second shaft being positioned substantially midway of the width of said float, said shafts extending at right angles to one another, said pendulum having an upper end pivotably mounted on said shaft, said float including two spaced sections between which said pendulum is pivotably supported on said second shaft and an arm connected to said sections, said pendulum weight being a flat member having a narrow upper portion and a widened lower portion, said lower portion having opposite ends each positioned for contacting a respective float section depending on the direction of inclination of the chamber.

* * * * *